US005145160A

United States Patent [19]

Nagashima et al.

[11] Patent Number: 5,145,160

[45] Date of Patent: Sep. 8, 1992

[54] SHEET SENDING APPARATUS

[75] Inventors: Takashi Nagashima, Habikino; Toshiyuki Nakamura, Shiga; Hideo Fukuda, Nishinomiya; Masanori Toyoda, Osaka; Naoki Nakashima, Kyoto; Ichiro Takahashi, Moriguchi; Munetaka Mukainishi, Osaka; Shouichi Kitagawa, Neyagawa; Masayoshi Okada, Shijo-nawate, all of Japan

[73] Assignee: Mita Industrial Co., Ltd., Osaka, Japan

[21] Appl. No.: 486,380

[22] Filed: Feb. 28, 1990

Related U.S. Application Data

[63] Continuation-in-part of Ser. No. 431,938, Nov. 6, 1989, abandoned.

[30] Foreign Application Priority Data

Nov. 30, 1988 [JP] Japan ..... 63-303089
Nov. 30, 1988 [JP] Japan ..... 63-303090

[51] Int. Cl.[5] ..... B65H 3/44

[52] U.S. Cl. ..... 271/9; 271/117; 271/127; 271/170

[58] Field of Search ..... 271/9, 18–19, 271/21–22, 109, 117, 118, 121, 127, 145, 162, 170, 157, 158, 160

[56] References Cited

U.S. PATENT DOCUMENTS 4,204,668 5/1980 Yanagawa ..... 271/109
4,337,935 7/1982 Sawada et al. ..... 271/9
4,363,477 12/1982 Miyashita ..... 271/9
4,395,034 7/1983 Fukui ..... 271/21
4,429,863 2/1984 Itoh et al. ..... 271/9
4,492,371 1/1985 Kan et al. .
4,579,328 4/1986 Hagihara et al. ..... 271/9
4,872,660 10/1989 Kameyama et al. .
4,896,871 1/1990 Idenawa ..... 271/9

FOREIGN PATENT DOCUMENTS 3135751 9/1981 Fed. Rep. of Germany .
634034 4/1983 Japan .
68758 4/1989 Japan .

OTHER PUBLICATIONS

Adams, L. "Paper Feed System", Mar. 1982, IBM Technical Disclosure Bulletin, vol. 24, No. 10 pp. 5028–5030.

IBM Technical Disclosure Bulletin, vol. 31, No. 4, Sep. 1988, pp. 344–346, New York, "Printer Having Single Sheet Bypass".

*Primary Examiner*—Robert P. Olszewski
*Assistant Examiner*—Boris Milef
*Attorney, Agent, or Firm*—Beveridge, DeGrandi & Weilacher

[57] ABSTRACT

An apparatus for manually sending a sheet of paper to the sheet handling machine (i.e., a feeding mechanism inside of a copying machine or printer) equipped with an automatic sheet-feeding cassette. The sheet sending apparatus is composed of an upper chute and a lower chute articulated by gears. When the apparatus is used, the chutes make a flat angle to smoothly pass a sheet to the feed roller and the lower chute press down the stacked sheets of the sheet cassette. When the apparatus is not used, the chutes rotate and the lower chute leaves the feed roller. A sheet guide is attached at the lower end of the lower chute to prevent the sheet sliding on the chutes from falling in the sheet cassette, and the parts of the sheet guide corresponding to the separator of the sheet cassette is removed to allow natural flipping action of the sheet when the sheet is drawn out of the sheet cassette.

14 Claims, 7 Drawing Sheets

SHEET SENDING APPARATUS

The present invention relates to an apparatus for sending a sheet (of paper) to a sheet handling machine (such as a sheet feeding mechanism inside of a copying machine or a printer). This is a continuation-in-part application of the Ser. No. 07/431,938 filed on Nov. 6, 1989 now abandoned.

BACKGROUND

A typical copying machine 100 has some sheet cassettes 101 and 102 for different sheet sizes as shown in FIG. 7. Since automatic sheet feeding from the sheet cassettes 101 and 102 is difficult for small and stiff sheets such as post cards or name cards, some copying machines are provided with a manual sheet-sending chute 103. In this case, a sheet feeding roller 104, 105 or 106 is prepared for each sheet cassette or the chute 101, 102 or 103. Since a sheet is handled in only one of those 101, 102 or 103 at one time, the sheet feeding rollers 104, 105 and 106 are redundant.

Japanese Published Examined Utility Model Application No. S63-4034 discloses a sheet sending mechanism including an automatic sheet-feeding cassette, a manual sheet-sending chute and a single sheet feeding roller, where the sheet-sending chute is tiltable. When the sheet-sending chute is used, the end of the chute is brought near to the sheet feeding roller, and when it is not used, the end retires remote from the sheet feeding roller.

The prior art mechanism, however, needs a large stroke in moving the chute and much space to swing it. The large stroke needed to bring the chute to its operating position may sometimes cause difficulties in fixing it to the exact operable position.

SUMMARY OF THE INVENTION

The present invention is achieved to solve various problems accompanying a conventional manual sheet-sending chute used with an automatically sheet-feeding sheet cassette.

One of the objects of the invention is to reduce the stroke and space needed to move the sheet-sending chute between the operable position and the retired position, and to facilitate the exact positioning of the chute at the operable position.

Another object is to provide a smooth sheet sending through the chute even when an automatically sheet-feeding cassette is installed proximate to the manual sheet-sending chute.

A further object of the present invention is to provide an engaging mechanism to the sheet-sending chute to retain it at the retired position even when a housing of a copying machine equipped with the chute is swung up.

Still further object of the present invention is to provide smooth sheet feeding from the automatic sheet-feeding cassette, as well as from the manual sheet feeding apparatus, when the manual sheet-sending apparatus is installed near the sheet cassette.

Those and other objects are achieved by the apparatus of the present invention for sending a sheet of paper to a sheet feeder comprising an upper chute plate and a lower chute plate articulated to each other. Each chute plate has an axis of rotation different from that of the other, and the apparatus is fixable at two positions: one is an operable position where the upper chute plate and the lower chute plate make a substantially flat angle and an end of the lower chute plate is proximate to the sheet feeder; and the other is a retired position where the upper chute plate and the lower chute plate make a different angle and the end of the lower chute plate is distant from the sheet feeder.

In order to provide smooth sheet sending through the manual sheet-sending chute and from the automatic sheet-feeding cassette, a sheet guide is attached at the lower end of the lower chute. In this case, further, the part of the sheet guide that corresponds to the sheet separator of the sheet cassette is removed in order to assure natural movement of the sheet being drawn out of the cassette.

The sheet sending apparatus of the present invention includes some other features which will be shown in the following description of the preferred embodiment and the attached drawings.

BRIEF DESCRIPTION OF THE ATTACHED DRAWINGS

DETAILED DESCRIPTION OF A PREFERRED EMBODIMENT

Figure 1:
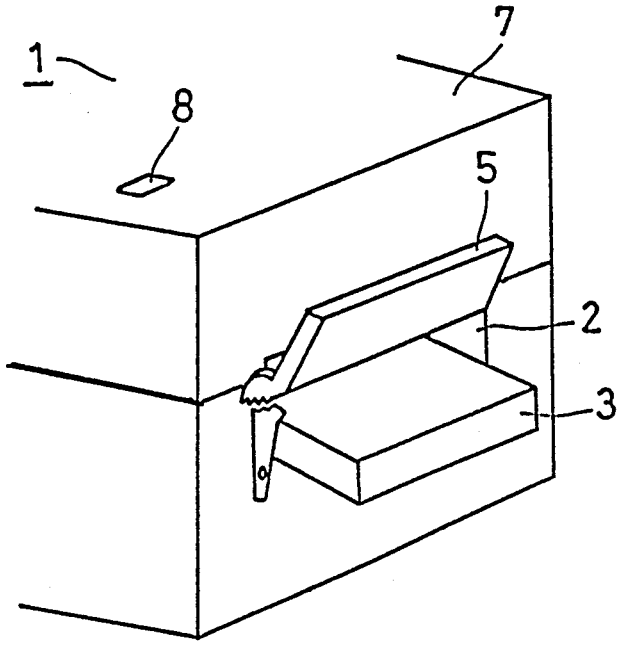
FIG. 1 is a perspective view of a copying machine equipped with the manual sheet-sending chute of the present invention and a sheet cassette.

FIG. 1 is a perspective view of a copying machine equipped with a manual sheet-sending apparatus according to the present invention. The manual sheet-sending apparatus (only whose upper chute 5 is shown in FIG. 1) is attached at the entrance 2 of the housing 7 of the copying machine 1. A sheet cassette 3 is also inserted in the entrance 2. The housing 7 is horizontally divided to allow maintenance of the inside. The manual sheet sending mode is indicated by the lamp 8 on the top of the housing 7.

Figure 2:
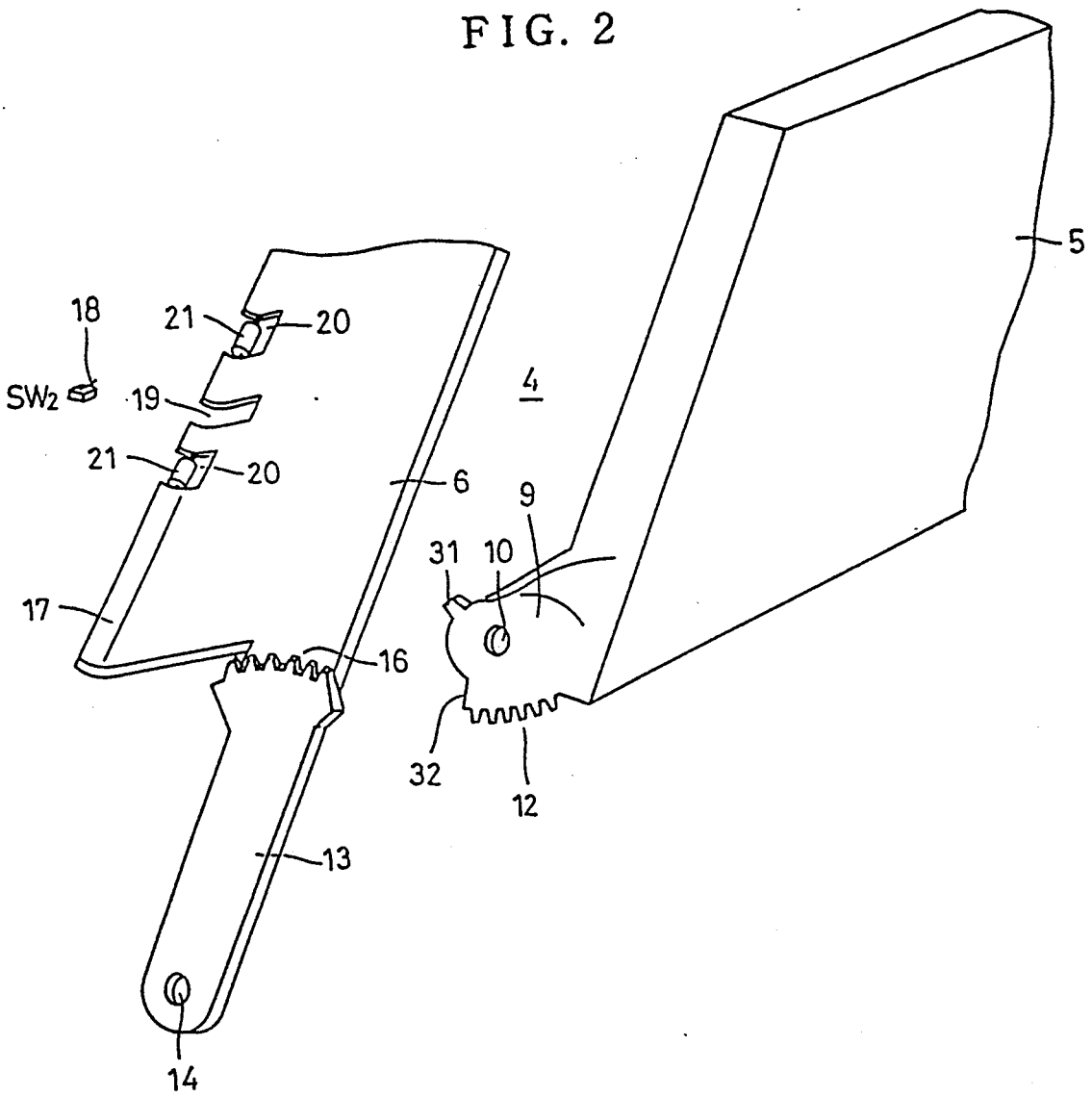
FIG. 2 is a separate perspective view of the upper chute and the lower chute of the sheet-sending apparatus.

FIG. 2 shows the upper chute 5 and lower chute 6 of the manual sheet-sending apparatus 4 separately. Normally they engage via gears 12 and 16. The upper chute 5 is made one piece where the side ends 9 of the lower edge rise up from the chute plate to form semicircles with holes 10 at the center. The holes 10 are loosely mounted on an upper axis 11 fixed on the housing 7

(FIGS. 3 and 4), thus allowing rotation of the upper chute 5. At the lower part of the periphery of each end 9 is formed a first gear 12.

The lower chute 6 is also formed one piece, including arms 13 (only one of which is shown in FIG. 2) extending downward from both sides of the chute plate. The lower ends of the arms 13 have holes 14 which are also loosely mounted on a lower axis 15 fixed on the housing 7 (FIGS. 3 and 4), whereby the lower chute 6 rotates on the axis 15. At the top of each arm 13 is formed a second gear 16 to be engaged with the first gear 12 of the upper chute 5. The chute plate of the lower chute 6 slants downward toward inside of the housing 7, with the lower edge 17 slightly turning upward. A notch 19 is formed at the center of the lower edge 17 for an antenna 18 of a sheet sensing switch $SW_2$, and at both sides of the central notch 19 are formed side notches 20 for auxiliary sheet rollers 21.

Figure 3:
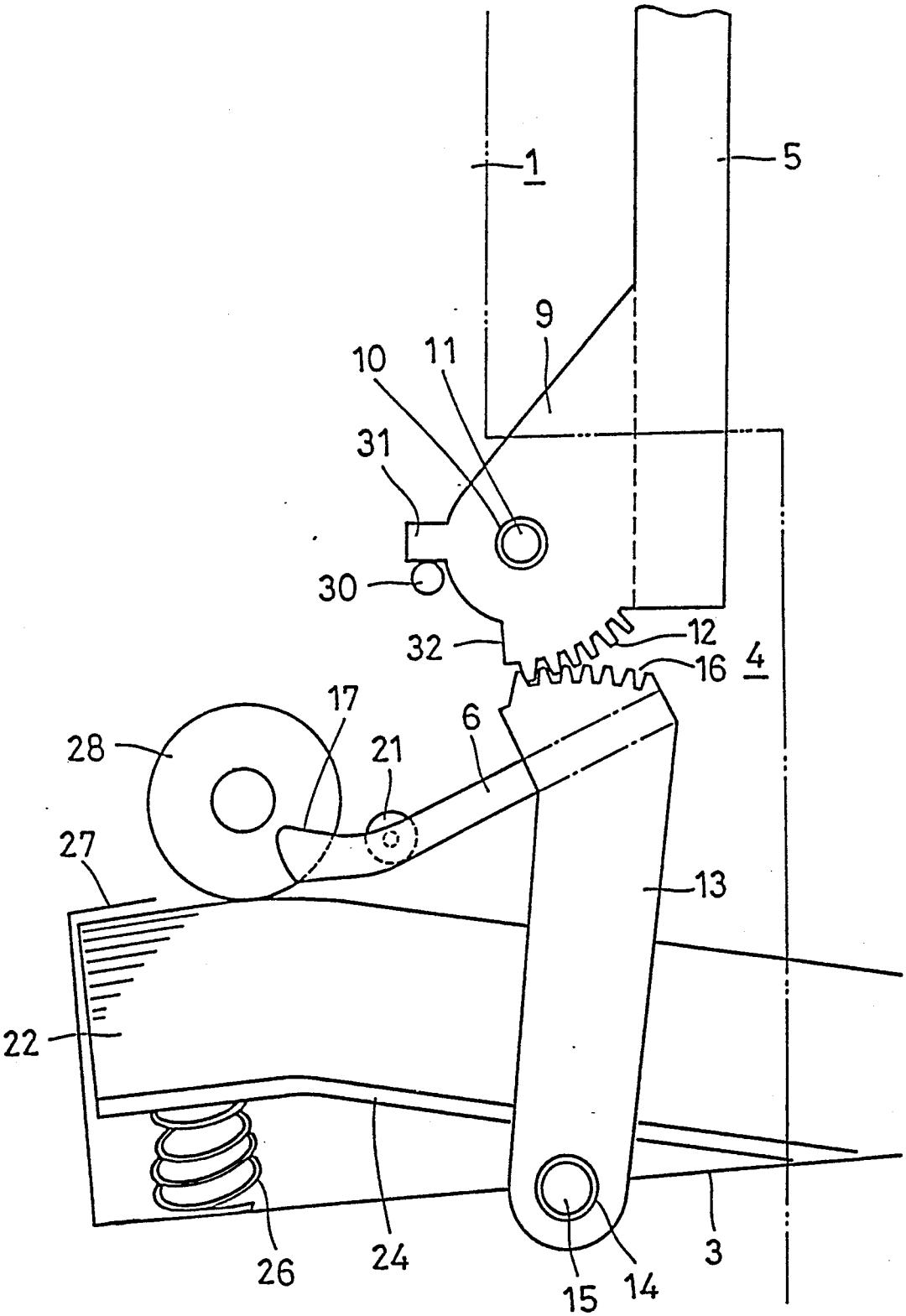
FIG. 3 is a side view of the sheet-sending apparatus and the sheet cassette when the sheet-sending apparatus is at the retired position.
Figure 4:
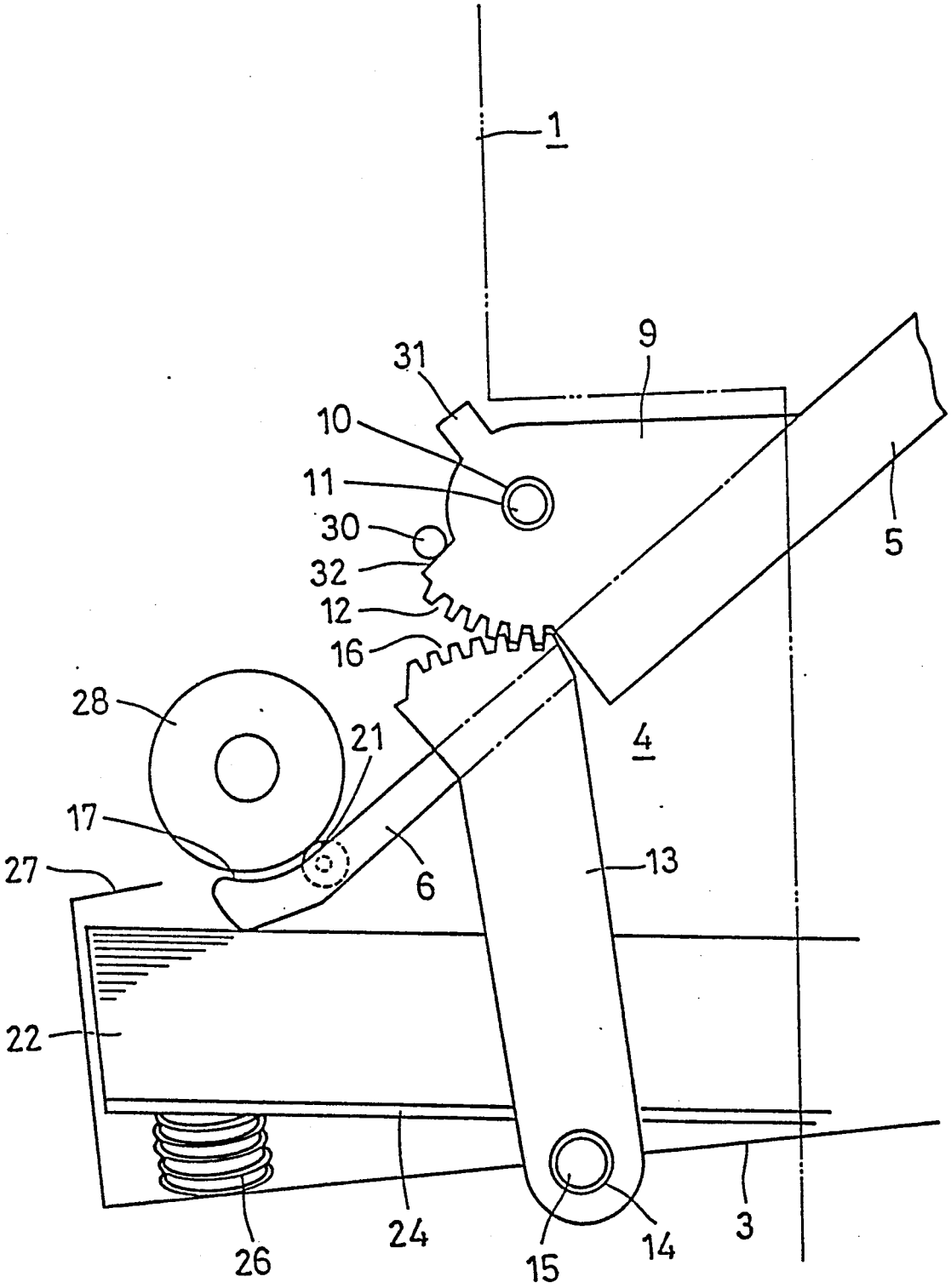
FIG. 4 is a side view of the sheet-sending apparatus and the sheet cassette when the sheet-sending apparatus is at the operable position.

FIG. 3 shows the upper chute 5 and the lower chute 6 of the manual sheet-sending apparatus 4 at their retired positions, and FIG. 4 shows them at their operating positions.

When the manual sheet-sending apparatus 4 is not used, the upper chute 5 is turned up until a tongue 31 on the semicircular end 9 abuts a stopper 30 fixed on the housing 7, when the chute plate is vertical as shown in FIG. 3. At this time, the lower chute 6 engaged with the upper chute 5 by the gears 12 and 16 is rotated clockwise in FIG. 3 on the lower axis 15. No stopper is needed for the lower chute because it is engaged with the upper chute via gears 12 and 16. The sheets of paper 22 stacked on a tray 24 are pushed up by a spring 26 against a sheet feeding roller 28 at the front part of the sheet cassette 3, and only the uppermost sheet in the sheet cassette 3 is assuredly fed by the roller 28 into the copying machine 1 with the aid of the separator 27. The lower chute 6 keeps clear of the sheet stack 22 at this retired position, and works as an upper sheet guide while the sheets in the cassette 3 are fed.

Figure 5:
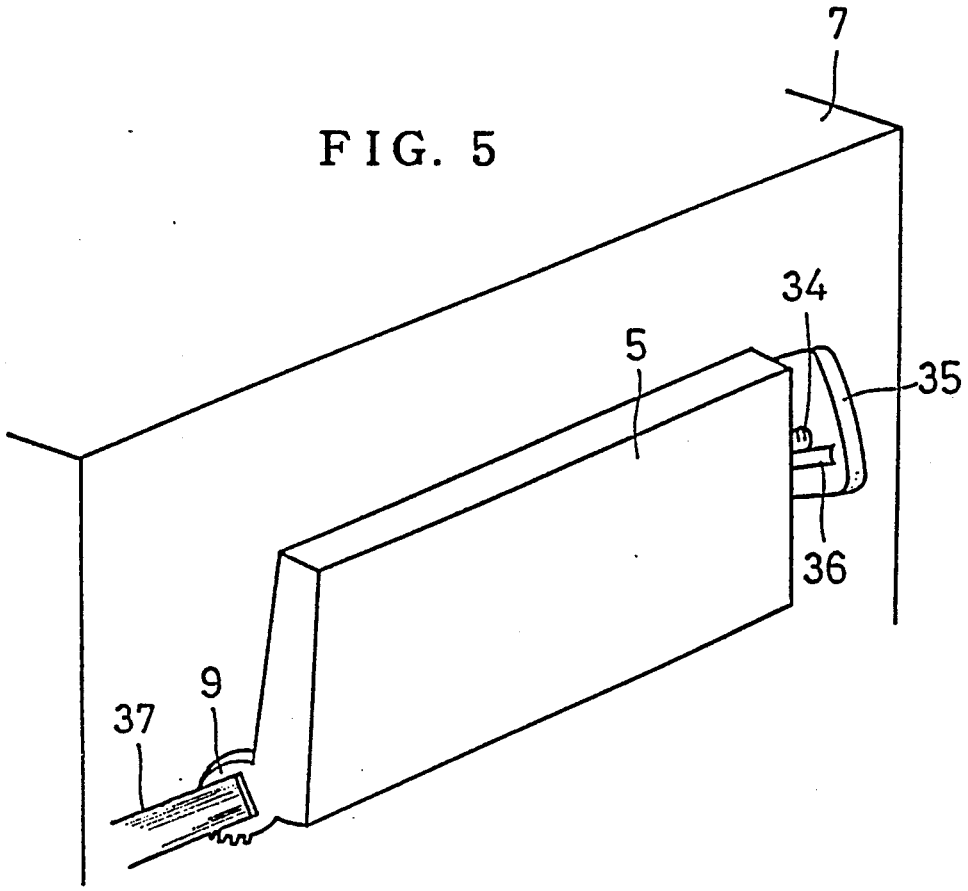
FIG. 5 is a perspective view of the upper chute of the sheet-sending apparatus when it is retained on the upper housing of the copying machine.
Figure 6:
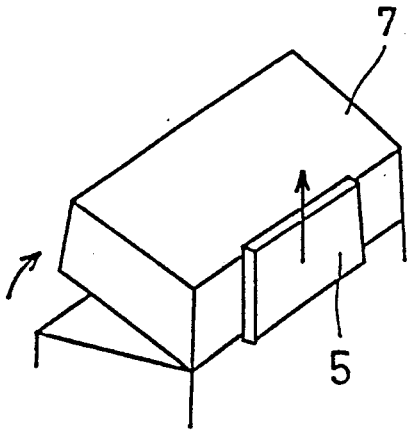
FIG. 6 shows the movement of the upper chute while the upper housing is swung up.
Figure 7:
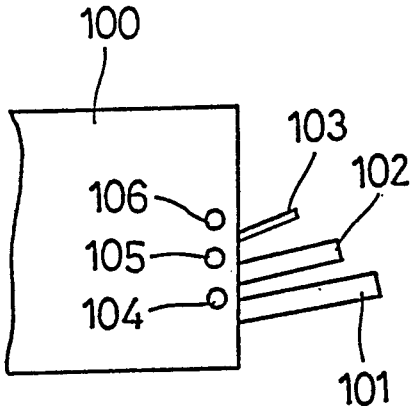
FIG. 7 Prior Art
FIG. 7 is an explanatory side view of a prior art copying machine equipped with a manual sheet-sending apparatus and two sheet cassettes.

When the upper chute 5 is turned up, it is held there by the engagement mechanism shown in FIG. 5. A small projection 34 on the right edge of the upper chute 5 overrides a stretched bump 36 rising from the engaging plate 35 supported on the housing 7 while the upper chute 5 is pressed rightward by a spring 37. The bump 36 on the engaging plate 35 stretches along the movement of the projection 34 so that the projection 34 does not fall down even when the upper part of the housing 7 is swung up, as shown in FIG. 6, to deal with sheet jamming (since the rotating axis of the upper housing and that of the upper chute 5 are different, the upper chute 5 moves upward in relation to the upper housing).

When the manual sheet-sending apparatus 4 is to be used, the upper chute 5 is pulled backward disengaging the protrusion 34 from the bump 36 against the spring 37 force (FIG. 5). The upper chute 5 rotates on the upper axis 11 until the edge 32 of the upper gear 12 abuts the stopper 30, as shown in FIG. 4. The lower chute 6 rotates counterclockwise this time and the lower end 17 of the chute plate of the lower chute 6 press down the sheet stack 22 separating it from the sheet feeding roller 28, whereby the sheets 22 in the sheet cassette 3 are not fed. When the upper chute 5 is stopped by the stopper 30, the chute plates of the upper chute 5 and lower chute 6 become flush to smoothly pass a sheet. When the upper chute 5 is tilted down, it turns on a transition switch (not shown) to enter the manual sheet sending mode. The manual sheet sending mode is indicated by the lamp 8 on the housing 7. When the sheet sensing switch $SW_2$ is turned on by a sheet sliding down the chute plates in the manual sheet sending mode, the sheet feeding roller 28 begins to rotate and the sheet is fed into the copying machine 1. The auxiliary rollers 21 reduce friction between the sheet and the lower chute plate while the sheet is fed, assuring smoother movement of the sheet, and the upturn 17 of the lower edge of the lower chute plate helps the sheet overpassing the separator 27 and prevents it from falling down in the sheet cassette 3.

As described above, the sheet-sending apparatus of the present invention is featured by the separate chutes. Since they rotate on different axes, the tilting stroke and the moving space of the chutes are small.

Figure 8:
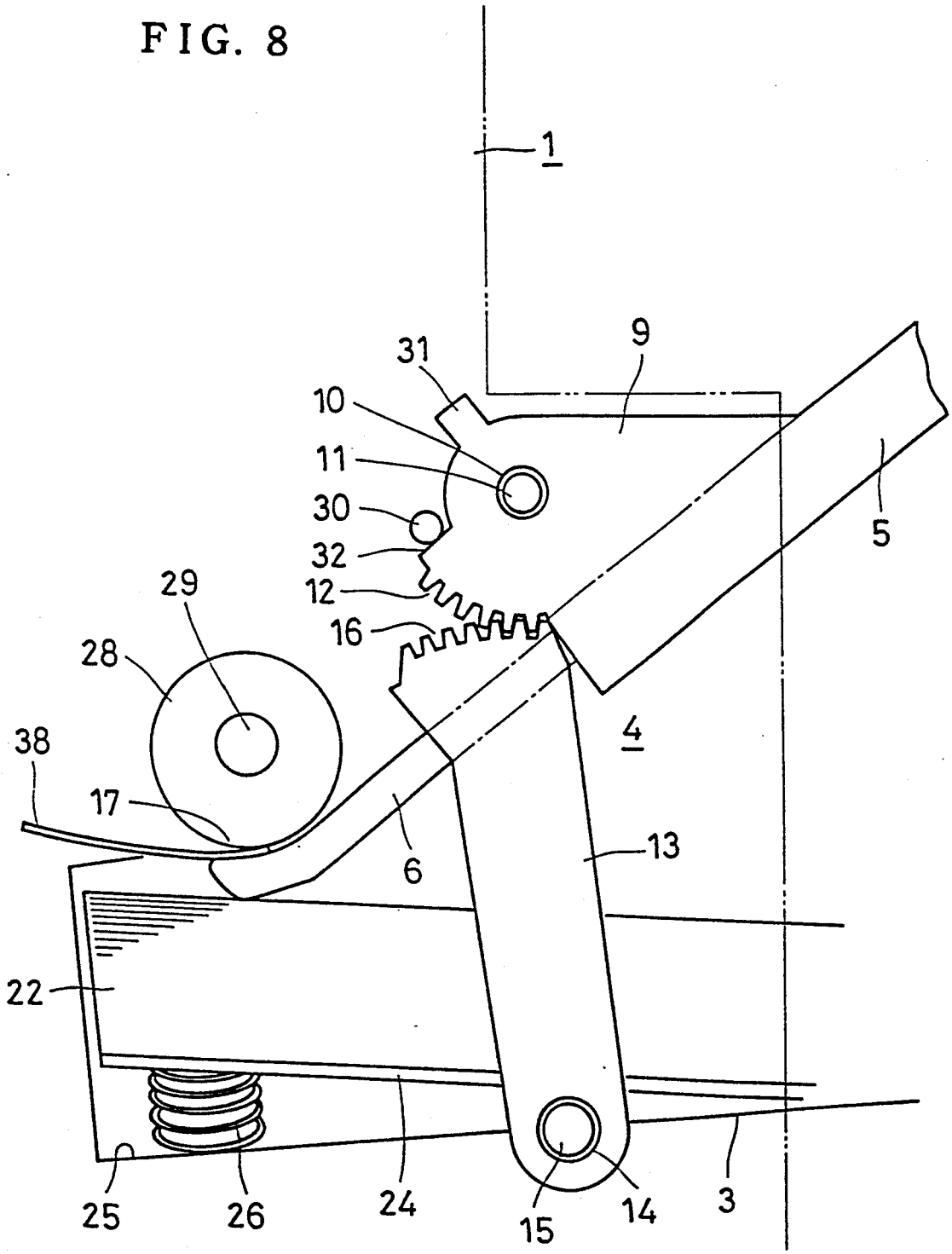
FIG. 8 is a side view of the sheet sending apparatus equipped with a resilient sheet guide at the lower end of the lower chute.

The second embodiment of the present invention is shown in FIG. 8, in which a sheet guide 38 is attached to the lower edge of the lower chute 6. The sheet guide 38 is made of a thin, resilient sheet of film, such as a polyester film, and is attached to the upturn edge 17 with a two-sided adhesive tape, etc. The sheet guide 38 extends well beyond the front (left in FIG. 8) edge of the sheet cassette 3 in order to prevent the sheet sliding on the chutes 5 and 6 from falling in the cassette 3 and to convey the sheet right to the sheet feeding mechanism inside of the copying machine 1.

Figure 9:
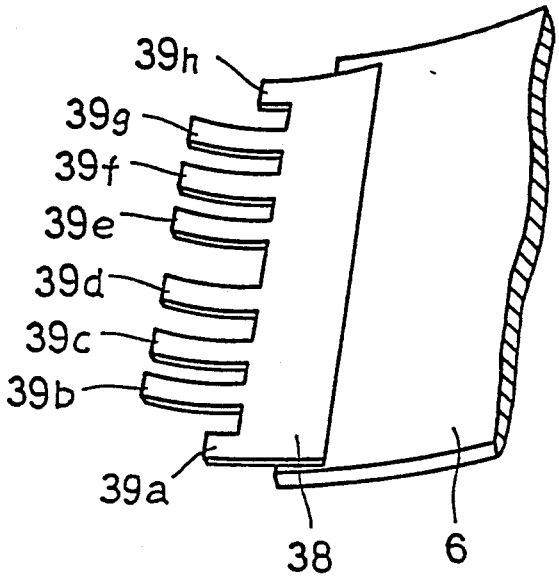
FIG. 9 is a perspective view of the sheet guide.

The free end of the sheet guide 38 is made further resilient by forming a plurality of tongues 39*a*–39*h* as shown in FIG. 9. If the copying machine 1 is adapted to handle a small sized sheet (such as a post card or name card), it is preferable to make the central tongues 39*d* and 39*e* thicker to assuredly support such a small sheet.

Figure 10:
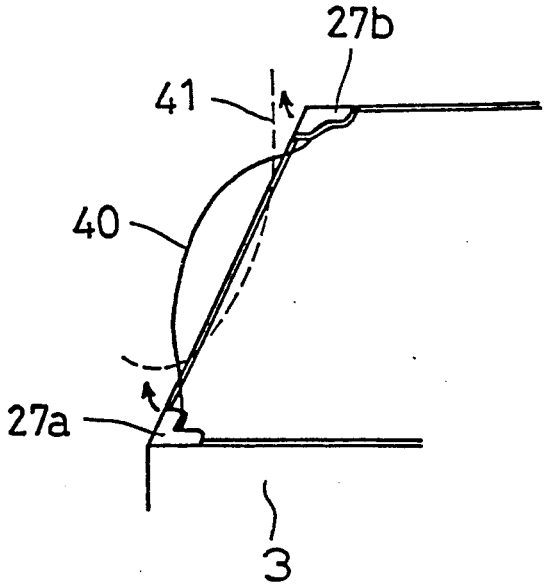
FIG. 10 is an explanatory view of the movement of the uppermost sheet when it is drawn out of the sheet cassette.

The side end pieces 39*a* and 39*h* of the tongues are made shorter in order to assure the flipping action of the sheet being sent out from the sheet cassette 3. The process is detailed with reference to FIG. 10. When the uppermost sheet of the sheet cassette 3 is to be fed, first the side corners of the sheet is temporarily held by the separators 27*a* and 27*b* of the cassette 3 while the sheet itself is being pushed forward. The central part of the front edge of the sheet bends as shown by the solid line 40, which ensures separation of the uppermost sheet from the second sheet on the sheet stack in the cassette 3. When the sheet is further pushed forward, the corners finally flee from the separators 27*a* and 27*b* and flip upward as shown by the dashed line 41. The flipping action of the corners is important for the front edge of the sheet to successfully escape from the sheet cassette 3. The end tongues 39*a* and 39*h* are made short so that it allows the flipping action of the corners of the sheet being drawn out of the cassette 3.

If the sheet guide 38 is made of a resilient rectangular sheet without the tongues, the corners corresponding to the separators 27*a* and 27*b* are to be cut off. Anyway, the important thing is that the part of the sheet guide corresponding to the separator of the sheet cassette is removed to allow the flipping action of the sheet fleeing the separator.

What is claimed is:

1. An apparatus for sending a sheet to a sheet feeder with the sheet feeder supported by a housing, comprising:

an upper chute plate with a first gear and a lower chute plate with a second gear in engagement with said first gear such that said upper and lower chute plates are articulated to each other, each chute plate having a first and a second end and each chute plate being pivotably supported by the housing such that each chute plate has an axis of rotation different from that of the other, and said chute plates being dimensioned and arranged for movement between a first and second position, the first position being an operable position wherein the upper chute plate and the lower chute plate make a substantially flat angle and the first end of the lower chute plate is in a feeding position with respect to the sheet feeder, and the second position being a retired position wherein the upper chute plate and the lower chute plate make an angle different from the substantially flat angle and the first end of the lower chute plate is in a non-feeding position with respect to the sheet feeder.

2. The sheet sending apparatus according to claim 1, wherein the first end of said upper chute plate has a tongue and an edge wall which together define a recess therebetween which is positioned to one side of said first gear, and said sheet sending apparatus further comprising a stopper supported by the housing which extends within the recess and is adapted to contact said edge wall for limiting articulation between said upper and lower chute plates.

3. The sheet sending apparatus according to claim 1, further comprising a sheet cassette containing a plurality of stacked sheets which is provided proximate to the sheet feeder when the sheet sending apparatus is at the retired position, and said sheet sending apparatus being dimensioned and arranged to have said lower chute plate push the stacked sheets away from the sheet feeder when the sheet sending apparatus is at the operable position.

4. The sheet sending apparatus according to claim 3, where the lower chute plate is positioned above and clear of the stacked sheets when the sheet sending apparatus is at the retired position and a sheet in the sheet cassette is fed by the sheet feeder.

5. The sheet sending apparatus according to claim 4, wherein the sheet cassette is provided under the sheet sending apparatus, and the first end of the lower chute plate bends slightly upward, whereby a sheet sent through the sheet sending apparatus passes over the sheet cassette when the sheet sending apparatus is at the operable position and a sheet in the sheet cassette is properly guided by the first end of the lower chute plate when the sheet sending apparatus is at the retired position.

6. The sheet sending apparatus according to claim 5, further comprising a sheet guide which is attached to the lower chute plate so as to extend away from the first end of the lower chute plate for guiding the sheet being sent through the upper and lower chute plates.

7. The sheet sending apparatus according to claim 6, wherein the sheet cassette has a front wall and two laterally spaced side walls intersecting the front wall, the sheet sending apparatus further including a sheet separator for separating a sheet being drawn out of the sheet cassette from other sheets remaining in the sheet cassette, and said sheet separator including separator members positioned at interior corners defined by the front and side walls of the sheet cassette, and said sheet guide including side edges and at least one elongated tongue member positioned between said side edges, and said sheet guide including recessed areas positioned directly above the separator members and positioned between said sheet guide side edges and said at least one elongated tongue member so as to allow for a flipping action of the sheet being drawn out of the sheet cassette.

8. The sheet sending apparatus according to claim 7, wherein a plurality of said elongated tongue members are provided at a downstream end of said sheet guide, and a pair of shorter length tongue members are provided at both sides of said sheet guide so as to provide the recessed areas which allow for the flipping action, and said elongated tongue members are positioned between said shorter length tongue members.

9. The sheet sending apparatus according to claim 8, where a plurality of centrally positioned elongated tongue members are stiffer than elongated tongue members positioned to each side of said centrally positioned elongated tongue members.

10. An apparatus for sending a sheet to a sheet feeder comprising:

a sheet cassette for containing a plurality of stacked sheets;

a sheet feeding roller for feeding the sheets from said sheet cassette;

sheet separators fixed to side portions of the front edge of the sheet cassette for separating a sheet being drawn out of the sheet cassette by the feeding roller from the other sheets remaining in the sheet cassette, said sheet separator being positioned above a front edge portion of the sheet to be drawn out of the sheet cassette;

a sheet guide placed above the edge of the sheet cassette having recessed areas that are positioned directly above said sheet separators so as to allow for a flipping action in the sheet being drawn out of the cassette wherein front edge corner portions of the sheet being drawn out of the sheet cassette extend into said recessed areas; and wherein said sheet guide includes a plurality of short length and long length tongues provided at one end of the sheet guide, and said short length tongues are provided at both sides of said sheet guide and said long length tongues are positioned between said short length tongues.

11. The sheet sending apparatus according to claim 10, wherein said long length tongues include a central pair of long length tongues and a plurality of additional long length tongues positioned externally with respect to said central pair of long length tongues, and said central pair of long length tongues being stiffer than said additional long length tongues.

12. An apparatus for sending a sheet to a sheet feeder with the sheet feeder supported by a housing, comprising:

an upper chute plate and a lower chute plate articulated to each other, each chute plate having a first and second end and each chute plate being pivotably supported by the housing so as to have an axis of rotation different from that of the other and an axis of rotation essentially fixed in position with respect to the housing, and said chute plates being dimensioned and arranged for movement between a first and a second position, the first position being an operable position wherein the upper chute plate and the lower chute plate make a substantially flat angle and the first end of the lower chute plate is in a feeding position with respect to the sheet feeder, and the second position being a retired position wherein the upper chute plate and the lower chute plate make an angle different from the substantially flat angle and the first end of the lower chute plate is in a non-feeding position with respect to the sheet feeder, and the sheet feeder including a sheet feed roller and the lower chute plate having a roller which is in contact with the sheet feed roller when the sheet sending apparatus is in the operable position.

13. A copying machine, comprising:

a housing;

a sheet feeder for feeding sheets within said copying machine which is supported by said housing;

a sheet sending apparatus for sending sheets to said sheet feeder, said sheet sending apparatus including an upper chute plate and a lower chute plate with each chute plate having a first and a second end and the second end of each of said chute plates being dimensioned and arranged so as to be in an articulating relationship with one another, each chute plate being pivotably supported by said housing so as to have an axis of rotation different from that of the other and essentially fixed with respect to the housing, said chute plates being dimensioned and arranged for movement between a first and second position, the first position being an operable position wherein the upper chute plate and the lower chute plate make a substantially flat angle and the first end of the lower chute plate is in a feeding position with respect to the sheet feeder, and the second position being a retired position wherein the upper chute pate and the lower chute plate make an angle different than the substantially flat angle and the first end of the lower chute plate is in a non-feeding position with respect to said sheet feeder, and said sheet sending apparatus further comprising a sheet cassette containing a spring and a plurality of stacked sheets biased upwardly by said spring, and said sheet cassette is provided proximate to the sheet feeder when the sheet sending apparatus is at the retired position, and said sheet sending apparatus being dimensioned and arranged to have said lower chute plate push the stacked sheets against the spring so as to move the stacked sheets away from the sheet feeder when the sheet sending apparatus is at the operable position.

14. An apparatus for sending a sheet to a sheet feeder, comprising:

a housing having a sheet cassette opening formed therein;

a sheet feeding roller supported in said housing;

a sheet cassette dimensioned and arranged for insertion within the sheet cassette opening so as to position a stack of sheets below a central axis of said sheet feeding roller, said sheet cassette including a spring and a spring biased tray, said spring urging said spring biased tray into a position where said spring biased tray is placed in contact with said sheet feeding roller;

an upper chute pivotably fixed to said housing;

a lower chute pivotably fixed to said housing, said upper and lower chutes including articulation means for articulating one chute with respect to the other chute into a first position wherein said upper and lower chutes are in a non-planar relationship with said lower chute positioned above and in a non-contacting relationship with a stack of sheets supported by said tray, and a second position wherein said upper and lower chutes are in an essentially planar relationship with said lower chute forcing the stack of sheets in said tray down and out of contact with said sheet feeding roller and with said lower chute having an outlet adapted to place a sheet into frictional contact with said sheet feeding roller, and said upper and lower chutes each having an axis of rotation essentially fixed in position with respect to said housing.

* * * * *